United States Patent [19]

Wichael

[11] Patent Number: 4,998,753

[45] Date of Patent: Mar. 12, 1991

[54] MULTI-PURPOSE COMPUTER READABLE DRIVER'S LICENSE

[76] Inventor: Sharon Wichael, 656 Juana, San Leandro, Calif. 94577

[21] Appl. No.: 503,820

[22] Filed: Apr. 3, 1990

[51] Int. Cl.[5] ..... B42D 15/00

[52] U.S. Cl. ..... 283/82; 283/904

[58] Field of Search ..... 283/82, 107, 109, 904

[56] References Cited

U.S. PATENT DOCUMENTS

| | | | |
|---|---|---|---|
| 4,589,687 | 5/1986 | Hannon | 283/109 |
| 4,593,936 | 6/1986 | Opel | 283/904 |
| 4,672,891 | 6/1987 | Maurer et al. | 283/904 |
| 4,705,299 | 11/1987 | Hedgcoth et al. | 283/904 |
| 4,897,533 | 1/1990 | Lyszczarz | 283/904 |

FOREIGN PATENT DOCUMENTS

| | | | |
|---|---|---|---|
| 2605935 | 5/1988 | France | 283/82 |

*Primary Examiner*—Paul A. Bell
*Assistant Examiner*—Hwei-Siu Payer
*Attorney, Agent, or Firm*—Phillips, Moore, Lempio & Finley

[57] ABSTRACT

A driver's license is in the form of a rigid plastic card similar to charge cards issued by bank and saving and loan institutions, e.g., Visa and MasterCharge cards. The owner of the driver's license has his or her photograph on the front side of the card in addition to standard identification indicia, such as the driver's license number, name and address. The owner's signature appears on the front or backside of the card, along with a machine and computer readable magnetic tape adapted to store and reveal additional pertinent information relating to the owner. For example, such information may include the owner's social security number, previous traffic citations, credit rating, information relating to automobile insurance, etc. In the preferred embodiment of this invention, a numerical and/or letter code is imprinted on the card to depict the class and type of information available on the magnetic strip.

6 Claims, 1 Drawing Sheet

MULTI-PURPOSE COMPUTER READABLE DRIVER'S LICENSE

TECHNICAL FIELD

This invention relates generally to a driver's license and more particularly to a driver's license formed as a rigid plastic card having a machine and computer readable magnetic tape secured thereon.

BACKGROUND OF THE INVENTION

A standard driver's license is normally imprinted on a paper-like material that tends to become marred and unreadable or torn. In addition, the driver's license only contains information relevant to personal identification, as required by the Department of Motor Vehicles of a particular state. In addition to using information imprinted on a driver's license for activities relating to driving an automobile, the license is also used for other purposes requiring personal identification.

For example, it is common practice for a local store clerk to require personal identification when a personal check is cashed. The commonest identification is provided by information on the purchaser's driver's license. Such information, along with the driver's telephone number, is normally written onto the back of the check by the clerk. This procedure is time consuming, gives rise to the transfer of inaccurate information on the check and does not insure that the check will be honored by the financial institution that issued the check to the purchaser-driver.

SUMMARY OF THE INVENTION

An object to this invention is to overcome the above, briefly described problems by providing a multi-purpose and computer readable driver's license adapted to not only retain information pertinent to a person's driving status, but also additional pertinent information, such as the person's financial capability to honor an issued check.

The driver's license comprises a rigid plastic card having photographic, signature and other identifying indicia visually displayed on the front side of the card in a manner similar to that provided by a conventional driver's license. In addition, a machine and computer readable magnetic tape is secured on the card to store and retrieve additional pertinent information relating t the person, such as the person's social security number, credit rating, the amount of funds retained in the person's checking account, the telephone number, etc. In the preferred embodiment of this invention, access codes are also imprinted on the card to indicate the type or class of information that can be accessed via computer read-outs.

BRIEF DESCRIPTION OF THE DRAWING

Other advantages and objects of this invention will become apparent from the following description and accompanying drawing wherein.

DESCRIPTION OF THE PREFERRED EMBODIMENT

Figure 1:
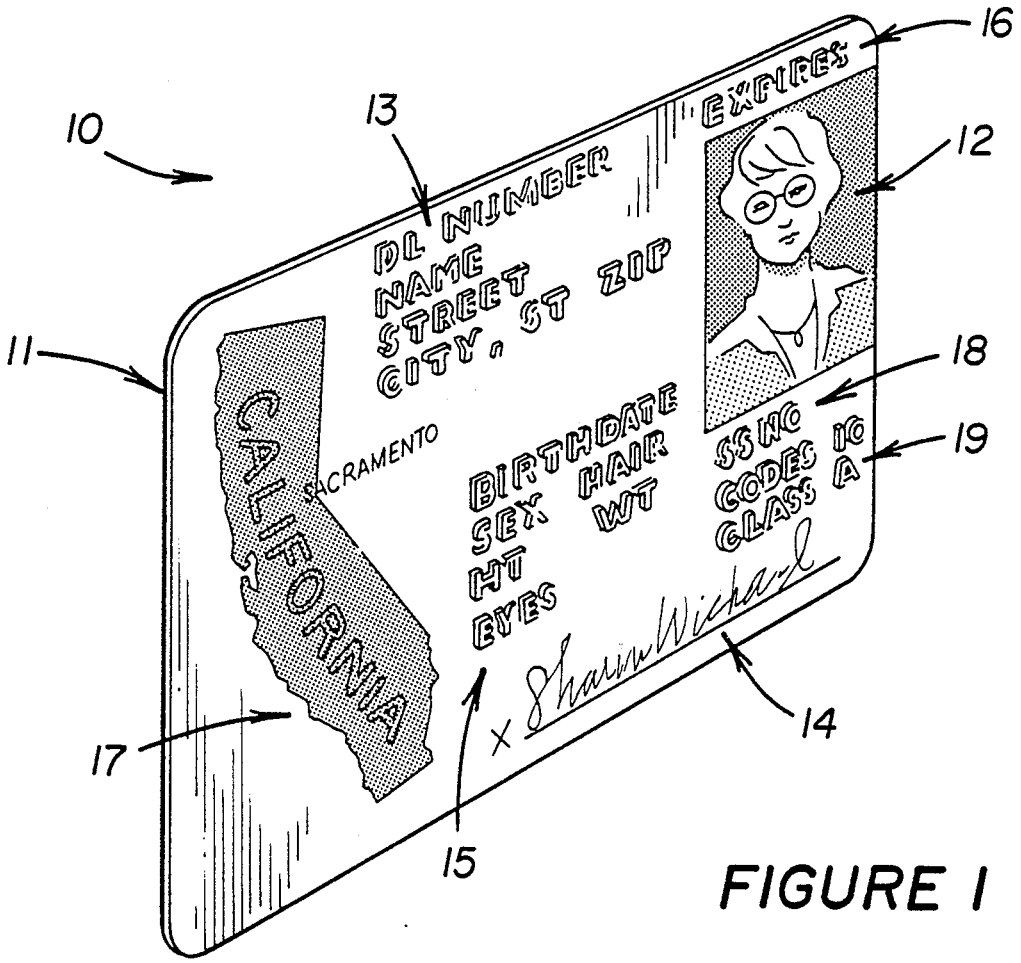
FIG. 1 is an isometric view of the front side of a multi-purpose computer readable driver's license embodying this invention.
Figure 2:
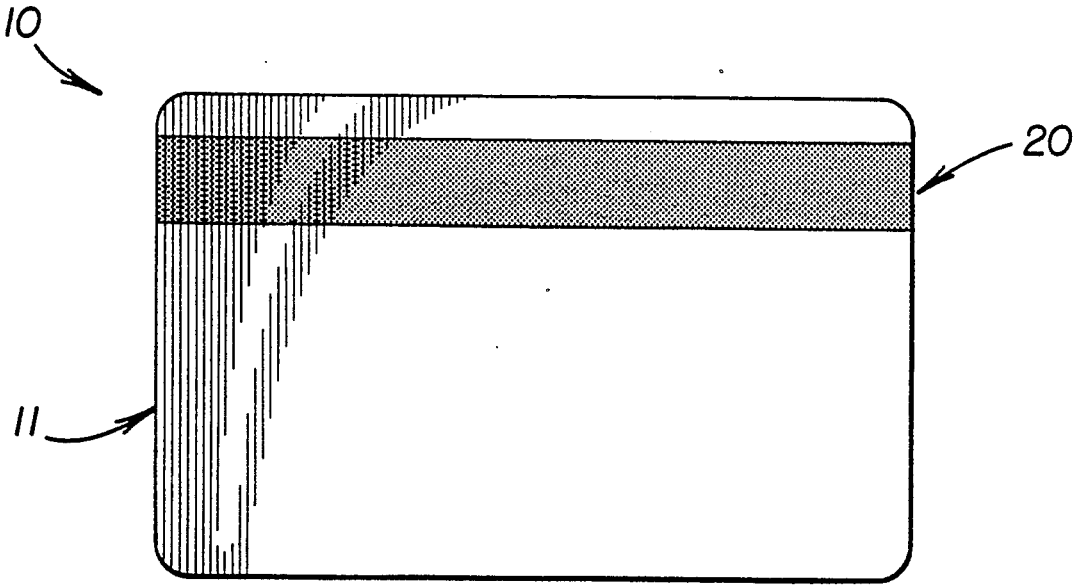
FIG. 2 is a plan view of a backside of the driver's license.

FIG. 1 illustrates a multi-purpose computer readable driver's license 10 adapted to provide information in addition to a person's driving status. The driver's license is formed as a rigid plastic card 11 composed of the same durable plastic material (e.g., polyvinylchloride or PVC) now used to compose standard credit cards, e.g. Visa and MasterCharge credit cards. The rigid and flexible plastic material utilized to form the card must exhibit similar physical and chemical characteristics, such as durability, toughness and resistance to normal chemical and thermal exposure.

Photographic indicia 12 is suitably secured on or laminated into the card to depict the person-owner of the driver's license. In addition, identification indicia 13 is formed by raised, embossed numbers and letters on the front side of the card. This visual information will identify the person-owner by at least his/her driver's license number, name and address.

A signature line 14 visually displays the signature of the person in a conventional manner. The signature can be laminated into the card and covered with a clear plastic layer in a conventional manner to prevent the signature from being marred or altered. Additional identification indicia 15, embossed or imprinted on the front side of the card, may include the person's birth date, sex, hair color, height and weight.

The expiration date of the license can also be embossed or imprinted at 16, on the upper right-hand corner of the front side of the card. The particular state 17 that issued the license can be graphically and visually displayed along one side of the front side of the card. Thus, licensing state will be readily apparent to the reader.

Additional personal information, such as the owner-driver's social security number 18, could also be suitably embossed or imprinted on the front side of the card. In the preferred embodiment of this invention, a numerical and/or letter access codes 19 are also embossed or imprinted on the front side of the card to depict the type of additional information available upon "reading" a magnetic strip or tape 20. The machine computer-readable magnetic strip is formed on the back side of the card in a conventional manner.

Various classes or types of information can be made available to the user, such as previous traffic citations and information relating to the driver's automobile insurance (code for traffic officer) or credit rating and savings account information. Thus, multi-purpose driver's license 10 can be used for matters directly related to driving a motor vehicle (e.g., traffic citations and accidents) or related to commercial transactions (check cashing and loans). Codes 19 would readily provide access to the information required for a particular situation. The information on strip 20, as well as the information imprinted on the front face of the card, could be readily updated periodically.

I claim:

1. A multi-purpose computer readable driver's license comprising a rigid plastic card having front and back sides, photographic indicia means on the front side of said card for depicting the person-owner of said driver's license, identification indicia means on the front side of said card for visually identifying the person-owner by at least his/her driver's license number, name, and address, signature indicia means on one of the front and back sides of said card for visually displaying the signature of the person-owner, machine and computer readable magnetic tape means secured on one of the front and back sides of said card with additional pertinent information relating to the person-owner being stored on said tape means, and code indicia means on the front side of said card for depicting the class of classes of said additional pertinent information stored and available by use of said magnetic tape means, including information directly pertinent to the person-owner as a driver of a motor vehicle and/or information directly pertinent to the person-owner's financial and credit status.

2. The multi-purpose computer readable driver's license of claim 1 wherein said identification indicia means is formed by embossed numbers and letters on the front side of said card.

3. The multi-purpose computer readable driver's license of claim 1 or 2 further comprising additional identification indicia means on the front side of said card for visually identifying the person-owner by at least his/her birth date, sex, hair color, height and weight.

4. The multi-purpose computer readable driver's license of claim 1 or 2 further comprising means on the front side of said card for graphically and visually displaying the particular state that issued said license.

5. The multi-purpose computer readable driver's license of claim 1 or 2 further comprising indicia means on the front side of said card for visually displaying the social security number of the person-owner.

6. The multi-purpose computer readable driver's license wherein said additional pertinent information includes one or more of the person-owner's social security number, telephone number, previous traffic citations, automobile insurance information, credit rating and/or savings account information.

* * * * *